US008083034B2

(12) United States Patent
Bordwell et al.

(10) Patent No.: US 8,083,034 B2
(45) Date of Patent: Dec. 27, 2011

(54) LIFT CONTROL INTERFACE

(75) Inventors: Mark A. Bordwell, Olive Branch, MS (US); Robert W. Elliott, Madison, IN (US); David P. Porter, Columbus, IN (US); Jason T. Stewart, Harvest, AL (US); Michael A. Swartz, Madison, IN (US)

(73) Assignee: Vehicle Service Group, LLC, Madison, IN (US)

( * ) Notice: Subject to any disclaimer, the term of this patent is extended or adjusted under 35 U.S.C. 154(b) by 491 days.

(21) Appl. No.: 12/404,500

(22) Filed: Mar. 16, 2009

(65) Prior Publication Data

US 2009/0236183 A1 Sep. 24, 2009

Related U.S. Application Data

(60) Provisional application No. 61/038,197, filed on Mar. 20, 2008.

(51) Int. Cl.
*B66B 1/34* (2006.01)

(52) U.S. Cl. ..... 187/391; 187/210; 187/247

(58) Field of Classification Search ..... 187/203, 187/204, 207, 209, 210, 213, 219, 220, 247, 187/277, 391–393
See application file for complete search history.

(56) References Cited

U.S. PATENT DOCUMENTS

| | | | | |
|---|---|---|---|---|
| 6,315,079 | B1 | 11/2001 | Berends et al. | |
| 6,325,176 | B1 * | 12/2001 | Jensen | 187/222 |
| 6,634,461 | B1 | 10/2003 | Baker | |
| 6,840,351 | B2 * | 1/2005 | Wanner | 187/205 |
| 6,964,322 | B2 * | 11/2005 | Green et al. | 187/285 |
| 6,983,196 | B2 | 1/2006 | Green et al. | |
| 7,014,012 | B2 * | 3/2006 | Baker | 187/247 |
| 7,025,178 | B2 | 4/2006 | Wengelski et al. | |
| 7,191,038 | B2 | 3/2007 | Green et al. | |
| 7,445,240 | B2 | 11/2008 | Ichimura et al. | |
| 7,500,816 | B2 * | 3/2009 | Berends et al. | 414/458 |
| 7,740,109 | B2 * | 6/2010 | Moller et al. | 187/247 |

(Continued)

FOREIGN PATENT DOCUMENTS

| | | |
|---|---|---|
| WO | WO 98/31183 | 7/1998 |

OTHER PUBLICATIONS

International Search Report dated Jun. 25, 2009 for Application No. PCT/US2009/037244.

(Continued)

*Primary Examiner* — Anthony Salata
(74) *Attorney, Agent, or Firm* — Frost Brown Todd LLC

(57) ABSTRACT

A lift control interface is operable to control and monitor a lift system. Each lift column in the system has such a lift control interface. The lift control interface allows a user to assign lift columns to a lift system. One or more of the assigned lift columns may be assigned to a column control group. The user may lock the selection of these columns. The status of the assigned, selected, and locked lift columns may appear on every lift control interface in the lift system. The user may govern operation of the selected columns in the column control group from a single control interface, such as any control interface at any of the selected columns. The lift control interfaces may include visual representations showing the relationships between the lift columns and a vehicle, such as with lift column icons being positioned around a vehicle icon.

20 Claims, 7 Drawing Sheets

U.S. PATENT DOCUMENTS

2007/0096068 A1 5/2007 Finkbeiner

OTHER PUBLICATIONS

Screenshots from http://www.gayusa.com/sireless_lift.asp, printed Mar. 17, 2009.

Screenshots from http://mohawklifts.com/consumer/mp-series.php, printed Mar. 17, 2009.

Screenshots from http://stertil-koni.com/en/Home/wireless_mobile_lifts.html, printed Mar. 17, 2009.

"Stertil-Koni: Your Heavy Duty Lifting Partner," Stertil-Koni USA Inc., Stevensville, Maryland, pp. 1-6.

International Preliminary Report on Patentability dated Sep. 21, 2010 for Application No. PCT/US09/037244.

* cited by examiner

LIFT CONTROL INTERFACE

PRIORITY

This application claims priority from the disclosure of U.S. Provisional Patent Application Ser. No. 61/038,197 entitled "Lift Control Interface," filed Mar. 20, 2008, the disclosure of which is incorporated by reference herein in its entirety.

BACKGROUND

Some versions of the present invention relate, in general, to vehicle lifts and their controls and, more particularly, to vehicle lifts having a communication and/or monitoring control system and display. Some vehicle lifts may comprise a plurality of columns. Users may desire to operate the lift by controlling multiple columns simultaneously from a single column. While a variety of systems and configurations have been made and used to control lift systems, it is believed that no one prior to the inventors has made or used the invention described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

DETAILED DESCRIPTION

The following description of certain examples should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

Figure 1:
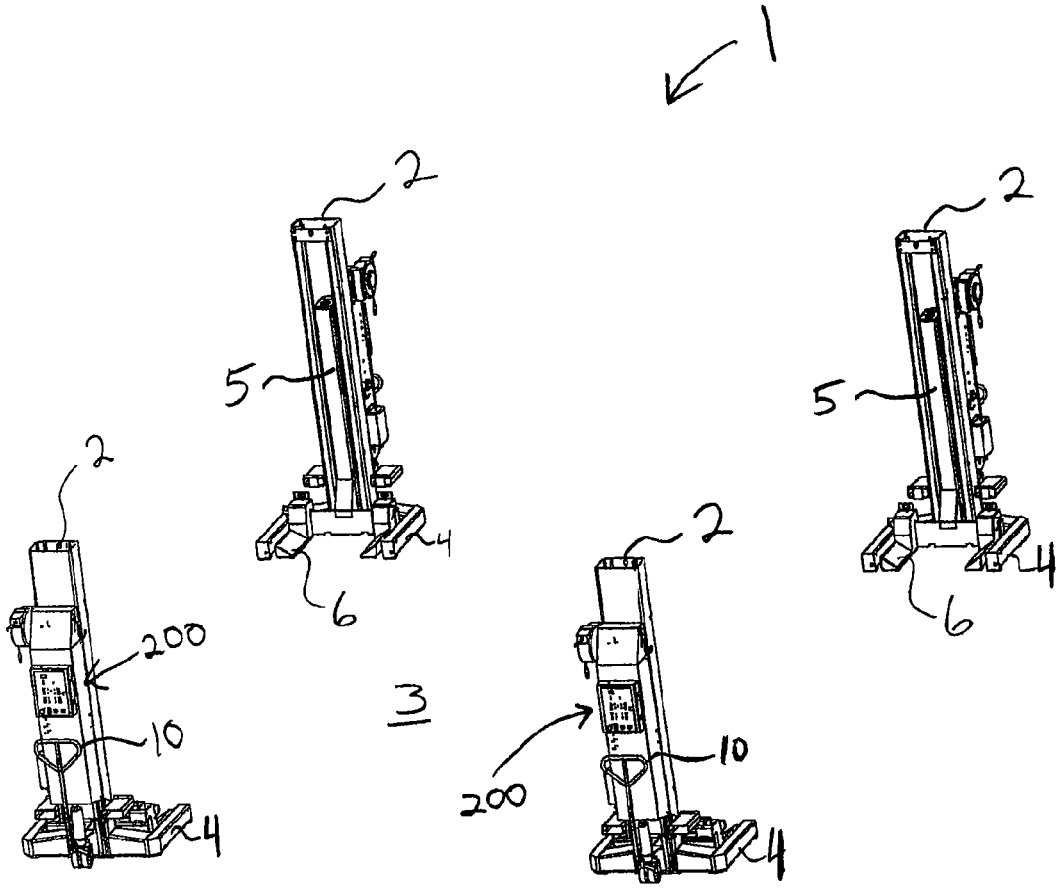
FIG. 1 shows a perspective view of an exemplary lift system.
Figure 2:
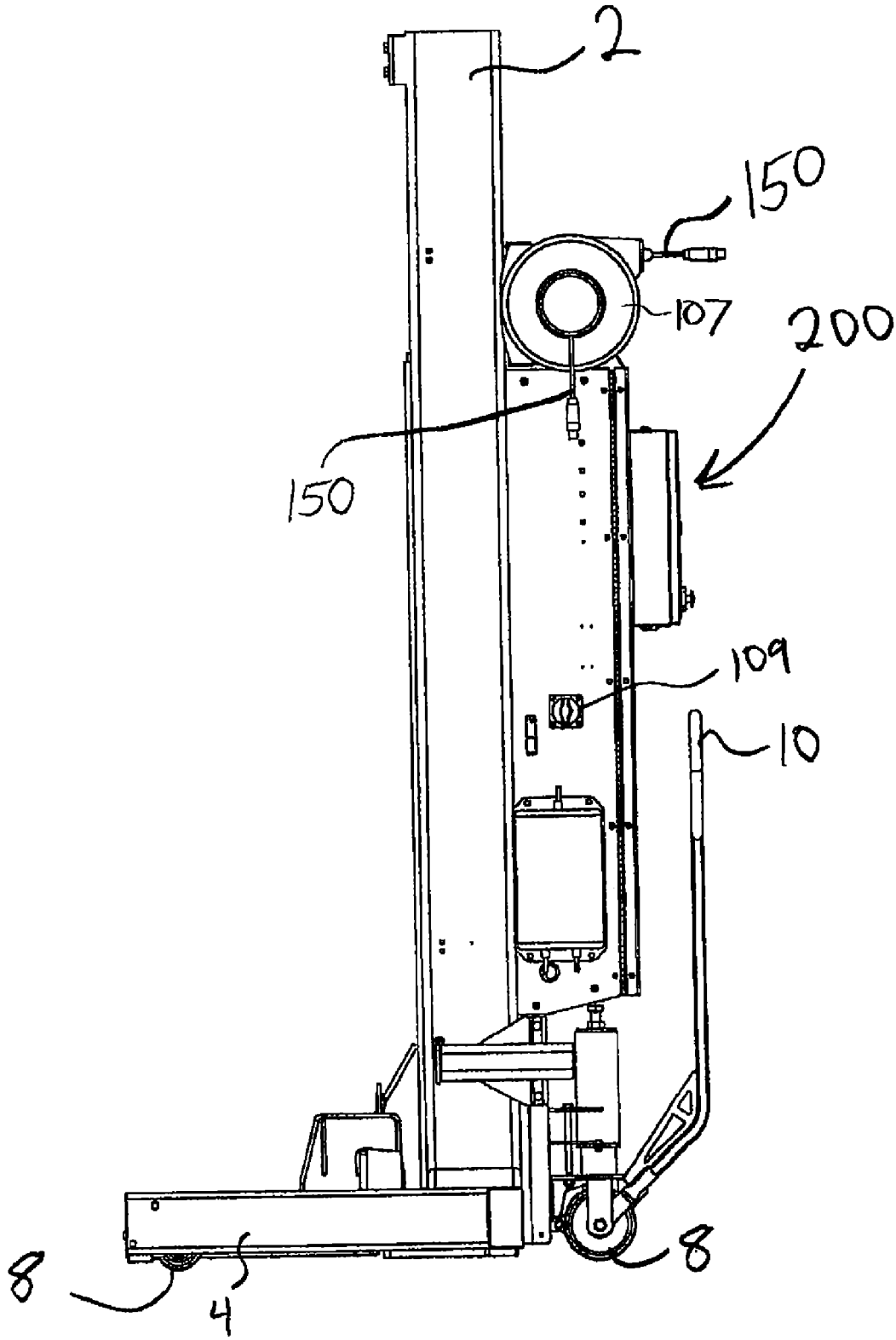
FIG. 2 shows a side view of an exemplary lift column of the lift system of FIG. 1.
Figure 3:
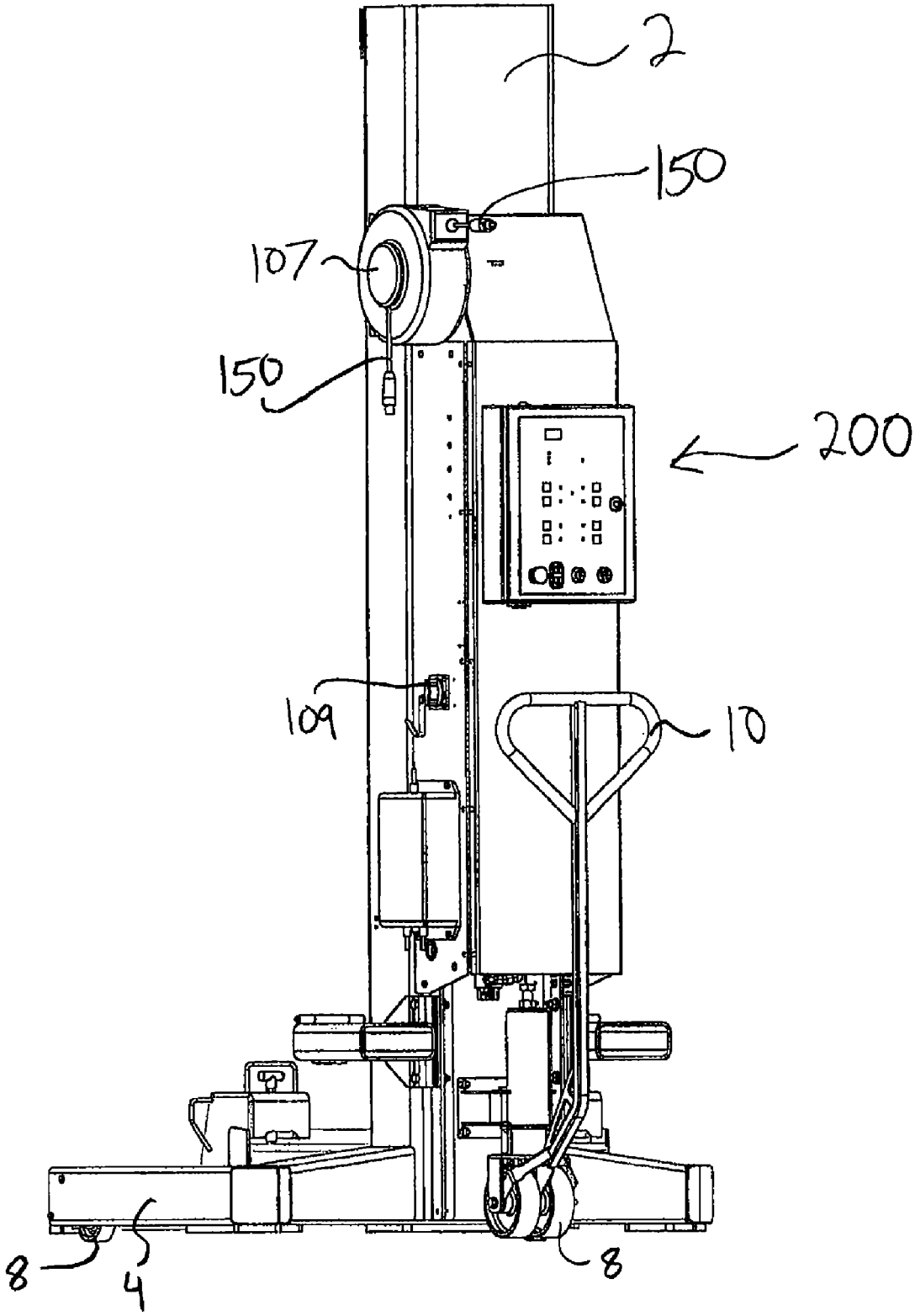
FIG. 3 shows a perspective rear view of the lift column of FIG. 2.
Figure 4:
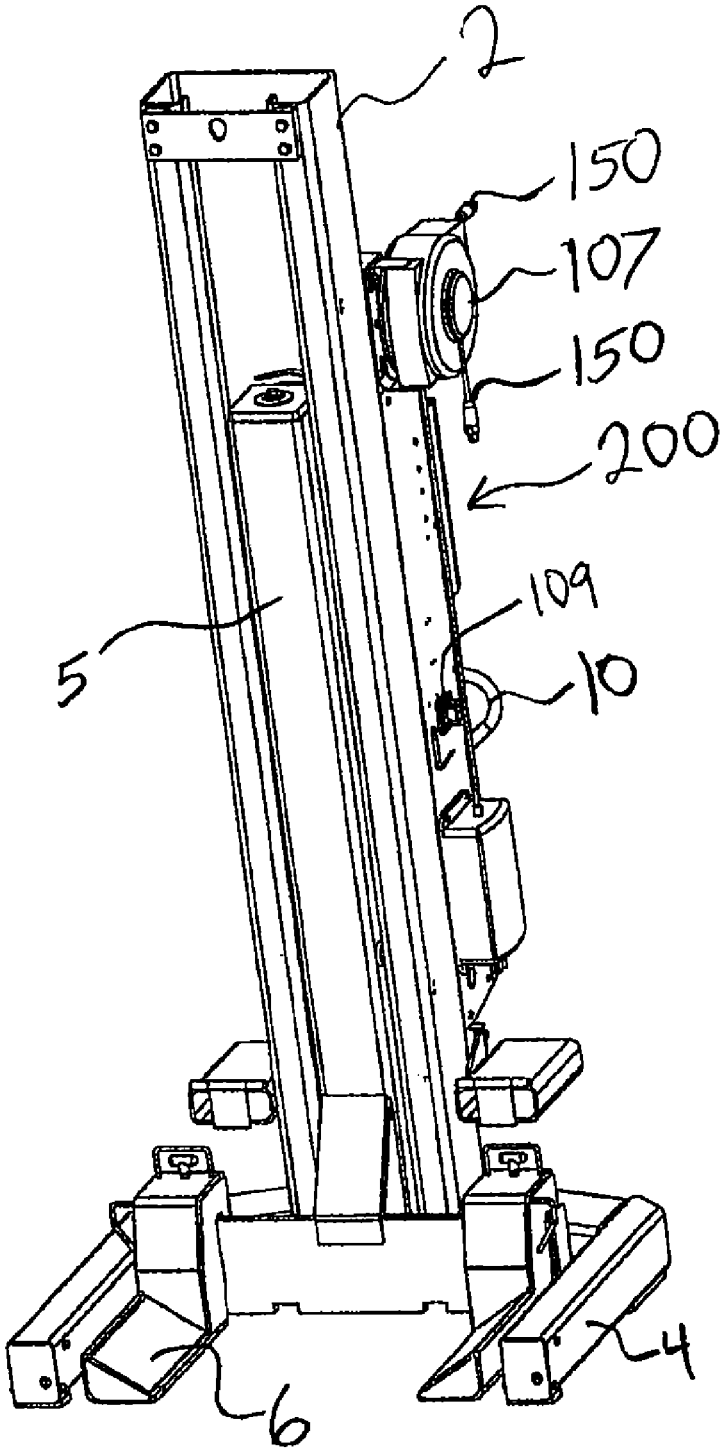
FIG. 4 shows a perspective front view of the lift column of FIG. 2.
Figure 7:
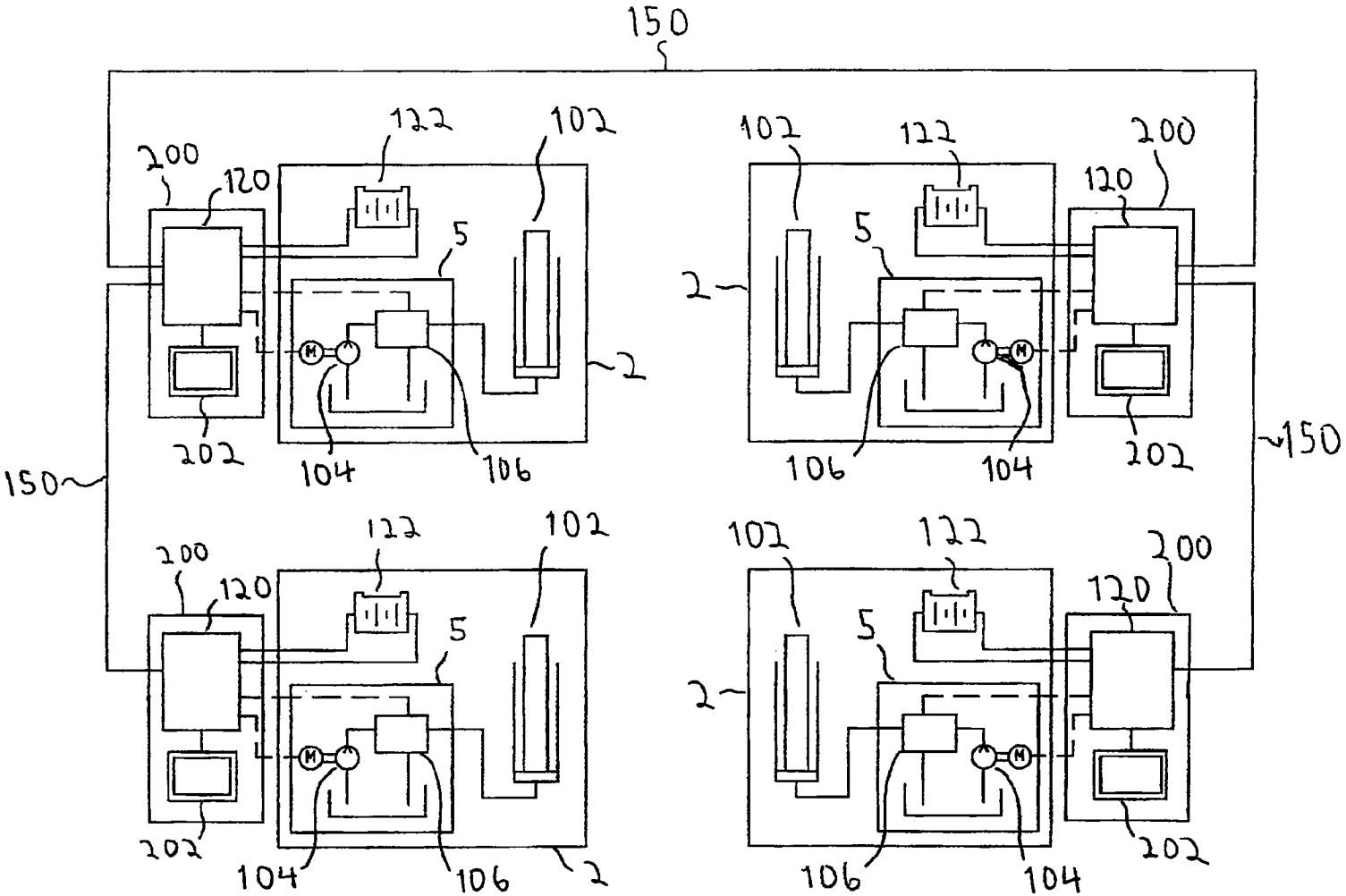
FIG. 7 shows a block schematic diagram of the lift system of FIG. 1.

FIGS. 1 and 7 illustrate an exemplary lift system (1) comprising a plurality of lifting columns (2) where lift system (1) may selectively serve to lift a vehicle or selectively set the vehicle on a ground (3). Lifting columns (2) may each be supported on the floor by leg components (4) as described in U.S. Provisional Patent Application Ser. No. 61/035,835 entitled "Modular Leg Wheel System," filed Mar. 12, 2008, the disclosure of which is incorporated by reference herein, or by any other suitable structure(s). By way of example only, the number of columns (2) may be four, six, eight, or any other suitable number of columns (2). Lift system (1) may provide an ascent mode and/or a descent mode directed to columns (2) according to a control system. An ascent and/or descent for all of columns (2) may be synchronized or coordinated to ensure the stability of the vehicle. However, circumstances may exist where only one column (2) or some, but not all, of columns (2) may otherwise raise or lower the vehicle. Other situations may call for raising or lowering carriers (6) at different rates, or making corrections to the ascent/descent rates of individual carriers (6). Several examples of circumstances surrounding the latter may include, but are not limited to, correcting any height differences or ascent/descent rates between lifting carriers (6); or elevating only a certain portion of the vehicle.

In the example of lift system (1) depicted in FIG. 1, lifting columns (2) may each comprise a hydraulic system (5) along which a carrier (6) can be moved, wherein carrier (6) serves to engage a component of the vehicle (e.g., the tire, bumper, or chassis of the vehicle, etc.). As shown in FIG. 7, one version of hydraulic system (5) may comprise some type of a mast to support carrier (6), a hydraulic cylinder and piston (102), a pump (104), and a series of valves (106) controlling the flow of hydraulic fluid. In particular, pump (104) and valves (106) may be in fluid communication with hydraulic cylinder and piston (102), such that pump (104) and valves (106) communicate fluid to or from cylinder and piston (102). Since carrier (6) raises and lowers with the piston of hydraulic cylinder and piston (102), pump (104) and valves (106) may be controlled to control the vertical height at which carrier (6) is positioned. As described in greater detail below, a processor (120) is in electrical communication with pump (104) and valves (106) to control operation of pump (104) and valves (106). Of course, any other suitable structures, components, or techniques may be used for a hydraulic system (5). For instance, any suitable systems, features, mechanisms, or components may be used in addition to or in lieu of hydraulic system (5), including but not limited to a screw mechanism, such as to raise or lower carrier (6).

The example of lift system (1) depicted in FIG. 1 may further comprise a lift control interface (200) attached to each column (2). Lift control interface (200) may control the operation, monitoring, and/or programming of lift system (1). For instance, and as will be described in greater detail below, lift control interface (200) may provide a user with a variety of control mechanisms for creating a configuration of at least one column (2), a selection of at least one column (2) within the configuration, and the movement of at least one carrier (6) in lift system (1).

As shown in FIGS. 1-4, columns (2) have wheels (8) and handles (10), permitting columns (2) to be moved along ground (3). Columns (2) of the present example may thus be selectively positioned with relative ease, as may be desired to accommodate different vehicles having different numbers of wheels (e.g., to move additional columns (2) into place or to move excess columns (2) away, etc.), to replace a first column (2) with a second column (2) for maintenance of the first column (2), etc. Of course, aspects described herein, including but not limited to the control interface (200) described herein, may also be applied to other types of columns (2) or other lift system (1) types, including in-ground types among others.

Columns (2) of the present example also have integral cables (150), such as to provide communication between columns (2), as will be described in greater detail below. By way of example only, each column (2) may have two cables (150), with one cable (150) being retractable relative to a casing (107) such as by a conventional recoil mechanism. One cable (150) on each column (2) may have a male coupling while the other cable (150) on the column (2) may have a female coupling. A retractable cable (150) of a first column (2) may be extended to a second column (2) to couple with the non-retractable cable (150) on the second column (2), thereby providing communication between the first and second columns (2). Alternatively, a retractable cable (150) of a first column (2) may couple with a port (109) on the second column (2) to provide communication between the first and second columns (2). As yet another variation, some other cable (not shown) may be used to couple ports (109) on first and second columns (2). Furthermore, communication between columns (2) may be wireless, may be a combination of wired and wireless, or may be provided in any other suitable fashion.

As shown in FIG. 7, and as will be described in greater detail below, each control interface (200) includes a display (202). Each control interface (200) in this example also includes a rechargeable battery (122). Each battery (122) is in electrical communication with processor (120) of its control interface (200), as well as display (202) of its control interface (200). Each battery (122) is also in electrical communication with hydraulic system (5) of its associated column (2). Rechargeable batteries (122) are thus configured to provide sufficient power to completely operate lift system (1). Rechargeable batteries (122) may comprise any suitable type of conventional battery, and may be charged using a preexisting power source. In some other version, batteries (122) only provide power to portions of lift system (1) (e.g., only to control interfaces (200), etc.). In still other versions, batteries (122) are omitted, and lift system (1) is powered entirely by a preexisting power source, such as via one or more cables.

As also shown in FIG. 7 and as noted above, each control interface (200) also includes a processor (120). Processors (120) may comprise any suitable type of conventional processor. Processors (120) of this example are configured to process instructions and information entered through control interface (200) by an operator as described below, and are further configured to provide commands to hydraulic systems (5). In addition, processors (120) are configured to receive data from height sensors (not shown), which are configured to sense the height of each carrier (6). Processors (120) may thus compare heights and/or ascent/descent rates of carriers (6), and issue commands to hydraulic systems (5) as needed or desired in order to make heights and/or ascent/descent rates substantially uniform among carriers (6) of columns (2) that are being used. Suitable techniques for accomplishing such coordinated or synchronized raising and lowering of carriers (6) will be apparent to those of ordinary skill in the art in view of the teachings herein.

Processors (120) are also in communication with each other in the present example. In particular, and as shown in FIG. 7, processors (120) communicate with each other via cables (150). In the present example, cables (150) are provided in an arrangement whereby two columns (2) have two cables (150) coupled to them, while two columns (2) only have one cable (150) coupled to them, such that cables (150) form a generally U-shaped configuration. Such a configuration of cables (150) may thus provide a less impeded opening between two columns (2). This less impeded opening may be located in a position where a driver would drive a vehicle to enter the space between columns (2), to engage parts of the vehicles with carriers (6). In other words, the driver will not have to drive over a cable (150) that is on the ground or through a cable (150) that is above the ground in order to position the vehicle between columns (2). If desired, however, all columns (2) may have two coupled cables (150), such that cables (150) form a complete loop.

Information that may be communicated between processors (120) of different control interfaces (200) will be described in greater detail below. By way of example only cables (150) may comprise conventional RJ45 cables or any other suitable type of cable. In other versions, processors (120) communicate with each other wirelessly, such that cables (150) are omitted. For instance, processors (120) may communicate with each other via a conventional "wi-fi" protocol, via BLUETOOTH, via ZIGBEE, or in any other suitable fashion, protocol, or modality. It should be understood that electrical communication between any components of lift system (1) may be provided via wires or wirelessly, or even a combination thereof. In other words, some components of lift system (1) may communicate via wires while other components of lift system (1) communicate wirelessly. Suitable ways in which components of lift system (1) may communicate via wire and/or wirelessly will be apparent to those of ordinary skill in the art in view of the teachings herein.

Lift control interface (200) of the present example provides a user with the ability to define column groups from at least one interface (200). Other versions may only provide a user with one interface (200) to define column groups. In other words, column groups may be defined using only one control interface (200) in the present example. In some versions, interface (200) may provide the user with the ability to control the selected column configuration from any control interface (200) on any column (2) of lift system (1). In other words, each column (2) in a group may have a control interface (200), and any such control interface (200) in the group may be used to selectively control any or all of the columns (2) in the group. Thus, in another example, a selected column configuration may comprise a plurality of columns (2) whereby each column (2) may have an attached control interface (200). In some versions, no specific column (2) is necessarily permanently designated as a master column (2) controlling at least one slave column (2). Similarly, one or more specific columns (2) may always be designated a slave column (2) controlled by the master column (2).

To the extent that a master/slave configuration is used, a column (2) that is designated as a master may be known as the master column (2) to a user, with the other columns (2) being known as slave columns (2) to the user. Any suitable method for selecting the master column (2) may be used, such as automatic selection or manual selection. One example of automatic selection may exist where the first column (2) to power on is automatically deemed the master column (2). Another method may permit the user to select the master column (2) manually. Alternatively, the columns (2) may "look" and behave in such a way that the user cannot perceive which column (2) is designated as the master column (2). The designation of master/slave status may be fixed (e.g., one particular column (2) in a given group is always designated as the master column (2) predeterminedly, or by a user, etc.) or may be dynamic (e.g., whichever column (2) is the first to be powered on will be automatically designated as the master column (2), with the remaining columns (2) in the group being automatically designated as slave columns (2)). Other ways in which master/slave designations may be made will be apparent to those of ordinary skill in the art in view of the teachings herein. Furthermore, in other versions, there may be no master/slave dichotomy at all. For instance, all lift columns (2) in a group may have equal status in terms of issuing and receiving commands, etc.

Yet further, in a version of lift system (1) comprising wireless control modules, the wireless modules may have different relationships independent of columns (2). In other words, some versions of lift system (1) may include a wireless control module associated with each column (2). To the extent that columns (2) have master/slave relationships, the wireless control modules associated with such columns (2) need not have the same master/slave relationships that correspond with their respective columns (2). For instance, a wireless control module that is associated with a master column (2) may itself have a "slave" designation. Likewise, a wireless control module that is associated with a slave column (2) may itself have a "master" designation. Wireless control modules associated with columns (2) may also lack master/slave relationships altogether in some versions of lift system (1).

In further versions of lift systems (1), there may be multiple master columns (2) in the same system having at least one slave column (2). Furthermore, where lift system (1) comprises at least one master column (2), lift system (1) may change which column (2) is the master. Any suitable method for achieving this may be used, including for example an automatic selection or a manual selection as noted above. For example, if there are two masters in a single lift system (1), lift system (1) may decide which master column (2) will remain as master and which master column (2) will become a slave column (2). In a version where no master column (2) exists (e.g., no columns (2) are designated as "master" or "slave" until the system (1) is powered on each time), lift system (1) may determine which column (2) will become the master column (2). In a further version, the configuration of lift system (1) (e.g., designations of which columns (2) are slave and which are master) will remain even after system (1) has been powered off. In other words, when columns (2) are powered back on, the previous configuration remains in some versions. One could also program lift system (1) such that only certain features remained configured to a particular setting after powering off lift columns (2).

In view of the above, it will be appreciated that at least three different configurations for lift system (1) may be provided—one where no column (2) is designated as "master," one where only a single column (2) is designated as "master," and one where more than one column (2) is designated as "master." Furthermore, to the extent that lift system (1) includes at least one column (2) designated as "master," such designation may be permanent (e.g., the one or more columns (2) designated as "master" has/have such designation before lift system (1) is first powered on and maintain(s) such designation throughout subsequent uses of lift system (1)); semi-permanent (e.g., one or more columns (2) is/are designated as "master" the first time lift system (1) is powered on, and such designation is maintained throughout subsequent uses of lift system (1)); on a "first on" ad hoc basis (e.g., the first column (2) to receive power each time lift system (1) is turned on is automatically designated as "master," and such designation may change each time lift system (1) is turned on); on a user-defined ad hoc basis (e.g., the user selects which column (2) will be designated as "master," such as by manipulating its user interface (200) first or otherwise); or in any other suitable fashion. To the extent that lift system (1) has somehow predeterminedly designated more than one column (2) as a "master," lift system (1) may further permit the user to select which of those columns (2) should be the true "master." Still various other ways in which the presence and selection of one or more master columns (2) may be implemented will be apparent to those of ordinary skill in the art. Of course, some versions of lift system (1) may lack a master column (2) altogether.

In the present example of lift system (1), at least one interface (200) on at least one column (2) may control all of columns (2) in a configuration or group. Where at least one interface (200) does control the column configuration, the remaining columns may be subject to the controlling interface (200). To the extent that a master/slave system is used, the controlling interface (200) may be labeled as a master interface (200) whereas the remaining control interfaces (200) may be labeled as slave interfaces (200). Alternatively, such labels may be omitted, such that all interfaces (200) in a group look the same.

As one version of lift system (1) is operated, the user may change or alternate using different control interfaces (200) on different columns (2) to effectively change which of the control interfaces (200) are master interfaces (200) and which of interfaces (200) are slave interfaces (200). The degree of control for a master interface (200) may vary for each lift system (1) depending upon a variety of factors including the version of the associated lift system (1) and/or the desire of the user. Different versions of lift systems (1) may have different sizes, shapes, hydraulic systems, and so on.

To the extent that a master/slave system is used, and more than one column (2) (e.g., all columns (2)) in a group has a control interface (200), the lift system (1) may permit the user to control some or all of the columns (2) in the group via any of the control interfaces (200)—even control interfaces (200) that are not mounted to a designated master column (2). For instance, commands entered by a user through control interface (200) that is mounted to a slave column (2) may be sent to the master column (2), and the master column (2) may then relay the command to the slave columns (2) for implementation. Such a configuration may thus render the "master" status of the master column (2) essentially invisible to the user. Other ways in which commands entered at control interface (200) on a slave column (2) may be implanted throughout the lift system (1) will be apparent to those of ordinary skill in the art in view of the teachings herein.

In some versions, lift system (1) may be configured such that control interface (200) is only attached to diagonally-opposite columns (2), columns (2) on a certain side of lift system (1), a single column out of a column (2) group, all columns (2) in a group, or in any other suitable configuration. The choice of the number of control interfaces (200) utilized by lifting system (1), as well as their arrangement among columns (2), may vary based on a variety of factors. Some of those factors may include the number of columns (2) being utilized in lifting system (1), the degree of convenient control desired by user, and safety concerns relating to operation of lift system (1).

Similarly, the degree of the control, monitoring, and programming associated with a version of control interface (200) may vary according to lift column (2) and/or lift system (1) associated with control interface (200). For example, control interface (200), as discussed in a previous example depicted in FIGS. 1-6, may comprise different indicators, different control functions as to the speed and/or style of the movement of the columns (2), different display screens, and so on.

Additionally, the attachment means used to otherwise physically connect lift control interface (200) to columns (2) may vary as desired. As shown in FIG. 1, one may physically attach interface (200) to column (2) using fasteners (e.g., bolts, screws, pins, etc.), an adhesive, welding, and/or any other suitable structures, components, or techniques. In other examples, one may attach interface (200) using a "loose" yet wired connection to permit a limited range of movement by interface (200) in relation to lifting system (1). In other versions, interface (200) may be wirelessly coupled with the column (2). For instance, lift data and/or commands may be communicated between control interface (200) and column (2) via one or more wires and/or wirelessly, such as using a remote computer (e.g., located elsewhere within the same facility in which columns (2) are located, located at another geographical location, located elsewhere, etc.) or using some other device that provides control interface (200) or that relays commands from control interface (200).

In some versions, a user may use a pendant, personal digital assistant, remote, handheld device, laptop computer, or any other suitable device to wirelessly communicate with column (2). A user may thus control lift system (1) without necessarily having to stand at column (2). Such a remote control device may present control interface (200) similar to one on column (2), or may have a different control interface that provides some or all of the same functionality of control interface (200) on a column (2), if not additional functionality. Furthermore, such a remote control device may communicate with control interface (200) on column (2); or with some other component on column (2) (e.g., bypassing at least a portion of control interface (200) on column (2). In still other versions, columns (2) may lack control interface (200) such that control of columns (2) is effected solely through a remote device. It will also be appreciated that a remote computer or computer system may communicate with lift system (1), either via wire or wirelessly. Still other ways in which one or more remote control devices may be integrated into lift system (1) will be apparent to those of ordinary skill in the art in view of the teachings herein.

In a further example, lift system (1) comprising a plurality of control interfaces (200) may comprise a combination of these attachment means for each different individual control interfaces (200). For example, where one control interface (200) is physically attached to one column (2), the remaining control interfaces (200) may be wirelessly coupled with the remaining columns (2). Yet further, various attachment means may be used in combination with a single control interface (200). For example, computer devices and/or personal digital assistants may be used in conjunction with control interface (200) physically attached to column (2) in order to access, control, program, monitor, and/or otherwise use interface (200).

Figure 5:
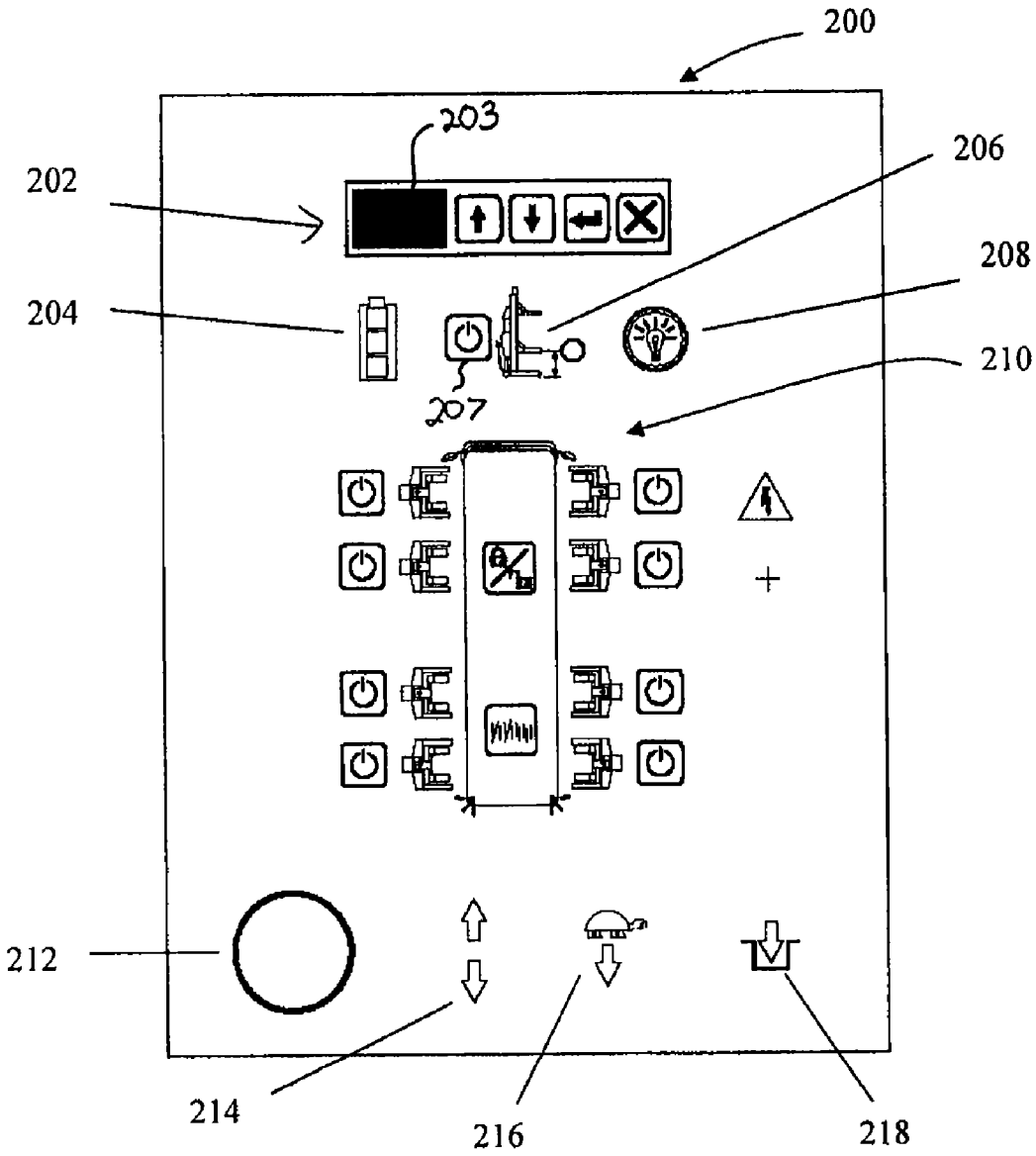
FIG. 5 illustrates an exemplary lift control interface.

Various examples of lift control interface (200) may incorporate and provide various capabilities, structures, components, and techniques. FIG. 5 depicts one example of lift control interface (200). Lift control interface (200) of this example comprises a display (202) that has a screen (203) and a control section (205) comprising a plurality of operational components. In this example, screen (203) comprises an LED display. As depicted, the 3-digit, 7-segment LED display may provide the user with information relating to a specific column (2) to which that interface (200) is attached. Control section (205) may permit the user to otherwise manipulate and/or control the LED display and/or any other aspects of the lift control interface (202). Any suitable display device may be used. For example, display (202) may comprise discrete LEDs, incandescent lamps, dot-matrix LEDs, LCDs, display numbers, letters, graphical indicators, graphical switches, and/or a touch screen, among other elements, including combinations thereof. Still other suitable types of display devices and input devices that may be integrated into lift control interface (200) will be apparent to those of ordinary skill in the art in view of the teachings herein.

Display (202) may also provide information regarding any and all columns (2) within lift system (1). In another version, display (202) may automatically or manually switch from displaying the information relating to a first column (2) to information relating to a second column (2) based on a series of existing conditions and/or the user's desire. In these versions, display (202) may be programmed accordingly to display certain objects and/or information. In another version, display (202) may communicate to the user information relating to the power supply available to a selected column (2) or column (2) group, a message or other code to the user describing an error associated with lift system (1) or related columns (2), or other information as so desired by the user.

In the example of display (202) in FIG. 5, a power supply reader (204) is positioned below display (202). Power supply reader (204) may serve to communicate to the user an indication of the power supply available to lift system (1), column (2), or a selected column configuration or group. For instance, as noted above, the power supply of the present example includes a battery (122), and power supply reader (204) may comprise a battery icon with bars indicating the remaining power left in the battery (122). Again, any other suitable power supply may be used (e.g., a conventional AC power line, etc.), if desired.

The example of interface (200) depicted in FIG. 5 further comprises a height limit component (206) adjacent to power supply reader (204). Of course, height limit component (206) and power supply reader (204) may have any other suitable arrangement. Height limit component (206) may serve to offer the user a visualization of the height setting for a carrier (6) of a column (2). For example, where a user selects a single column (2), height limit component (206) may provide the user with a visualization as to the height of the carrier (6) and/or the vehicle associated with that column (2). In another version, height limit component (206) may provide a user with a visualization of the height setting of a plurality of columns (2) and/or selected column (2) group. As for height limit component (206) and/or any other aspects of interface (200), the organization and layout of control interface (200) may vary as necessary and/or as so desired.

Height limit component (206) of the present example may be programmed to permit the user to operate column (2), a group of columns (2), and/or lift system (1) to at least one pre-programmed height. Examples of pre-programmed heights may include a stroke limit, an intermediate limit, and a maximum limit. The stroke limit may be a pre-programmed limit that prevents the fully "stroking out" of a cylinder in a hydraulic means (5). The stroke limit may be re-programmed any time a potentiometer of column (2) is recalibrated. For example, the stroke limit may set the stroke of column (2) to within one half inch of the value of the full stroke established during the calibration of column (2) potentiometer. Of course, any other value may be used to establish a stroke limit. The intermediate limit may be a limit that may be set by the user and may be stored in a memory of control interface (200). Finally, the maximum limit may be a limit establishing a maximum rise of column (2). This limit may be set or changed accordingly. Of course, a variety of other pre-programmed heights may be used as desired.

To the extent that a height limit is established and/or selected, the height limit may prevent columns (2) from raising carrier (6) any further after the height limit is reached. Suitable ways in which a height limit may be enforced will be apparent to those of ordinary skill in the art in view of the teachings herein, and may include but need not be limited to control of hydraulic means (5) and/or a braking function. Furthermore, a height limit may be set by selecting a pre-programmed height limit (e.g., using height limit component (206), such that height limits are established before lift system (1) reaches the user, etc.); or by a user manually entering a height limit (e.g., by entering a height value through control interface (200), etc.). Alternatively, control interface (200) may be configured such that there are no pre-programmed heights and/or such that a height limit may not be manually established.

As shown, height limit component (206) of the present example comprises a graphical representation of column (2) and carrier (6). Carrier (6) is depicted at three different height levels relative to column (2) in the depiction. For instance, the different height levels in the graphical representation may represent a stroke limit, an intermediate limit, and a maximum limit as described above. A user may activate a button (207) associated with height limit component (206) to cycle through settings for such pre-programmed heights. Button (207) may comprise a thin film switch with membrane overlay or any other suitable construction or configuration. As the user cycles through these settings by repeatedly activating button (207), the graphical representations of carrier (6) may selectively illuminate to represent the cycling through of height settings. For instance, upon initial activation of button (207) (or other input device), the vertically lowest graphical representation of carrier (6) may be illuminated, with the other graphical representations of carriers (6) being unilluminated. A second activation of button (207) may cause the vertically middle graphical representation of carrier (6) to be illuminated, with the other graphical representations of carriers (6) being unilluminated. A third activation of button (207) may cause the vertically top graphical representation of carrier (6) to be illuminated, with the other graphical representations of carriers (6) being unilluminated. When the user has cycled to the desired height limit, the user may refrain from further activation of button (207) associated with height limit component (206), and the selected height limit may be visually indicated by the last graphical representation of carrier (6) to be left illuminated. Other ways of selecting and indicating height limits will be apparent to those of ordinary skill in the art in view of the teachings herein.

In one example of control interface (200), a message may be sent to display (202) indicating that a limit has been reached when at least one carrier (6) approaches a certain height level. Yet further, in another example of control interface (200), height limit component (206) may comprise indicators indicating that a certain height level has been reached (e.g., a selected height limit has been reached, but not necessarily a height limit). In the example depicted in FIG. 5, height limit component (206) comprises an LED indicator, which illuminates when a selected height level has been reached by one or more carriers (6). Various types of indicators may be used to program, monitor, and/or change the current height limit. Additionally, indicators may provide other types of visual and/or audible messages to the user as to when a height limit is reached or is about to be reached.

Further, as depicted in the example of FIG. 5, an external light control (208) may permit a user to control external lights of lifting system (1), the external lights of the specific column (2) to which interface (200) is attached, and/or the external lights of any column (2) or a group of columns (2). For instance, external light control (208) may comprise a thin film switch operable to turn one or more lights on or off, or external light control (208) may comprise any other suitable construction or configuration. External light control (208) may also illuminate to indicate whether the one or more associated lights are turned on or off.

The exemplary interface (200) depicted in FIG. 5 also includes a column configuration panel (210) that permits a user to view and/or set a configuration of a plurality of columns (2). In the example shown in FIGS. 5-6, column configuration panel (210) depicts eight columns (2) in a control group, around an indication (308) of a bus. In other words, column configuration panel (210) of the present example shows a graphical representation (300) of columns (2), as well as a graphical indication (308) of a vehicle. Of course, one of ordinary skill in the art will immediately recognize that there are numerous other ways in which columns (2) and/or a vehicle may be graphically represented on column configuration panel (210), and the inventors contemplate that suitable representations may deviate substantially from the merely exemplary graphical representations (300, 308) shown in FIGS. 5-6. Furthermore, the graphical representations (300, 308) may simply include a graphical representation (300) of columns (2), without necessarily including a graphical representation (308) of a vehicle, and may include a variety of other graphical representations. Graphical representations (300) of columns (2) also need not necessarily "look like" columns (2)—the representations (300) may include any feature indicative of columns (2). Such alternative features may be non-numeric. Other ways in which column configuration panel (210) may be configured, including but not limited to its visual appearance and graphical representations (300, 308), will be apparent to those of ordinary skill in the art in view of the teachings herein.

Figure 6:
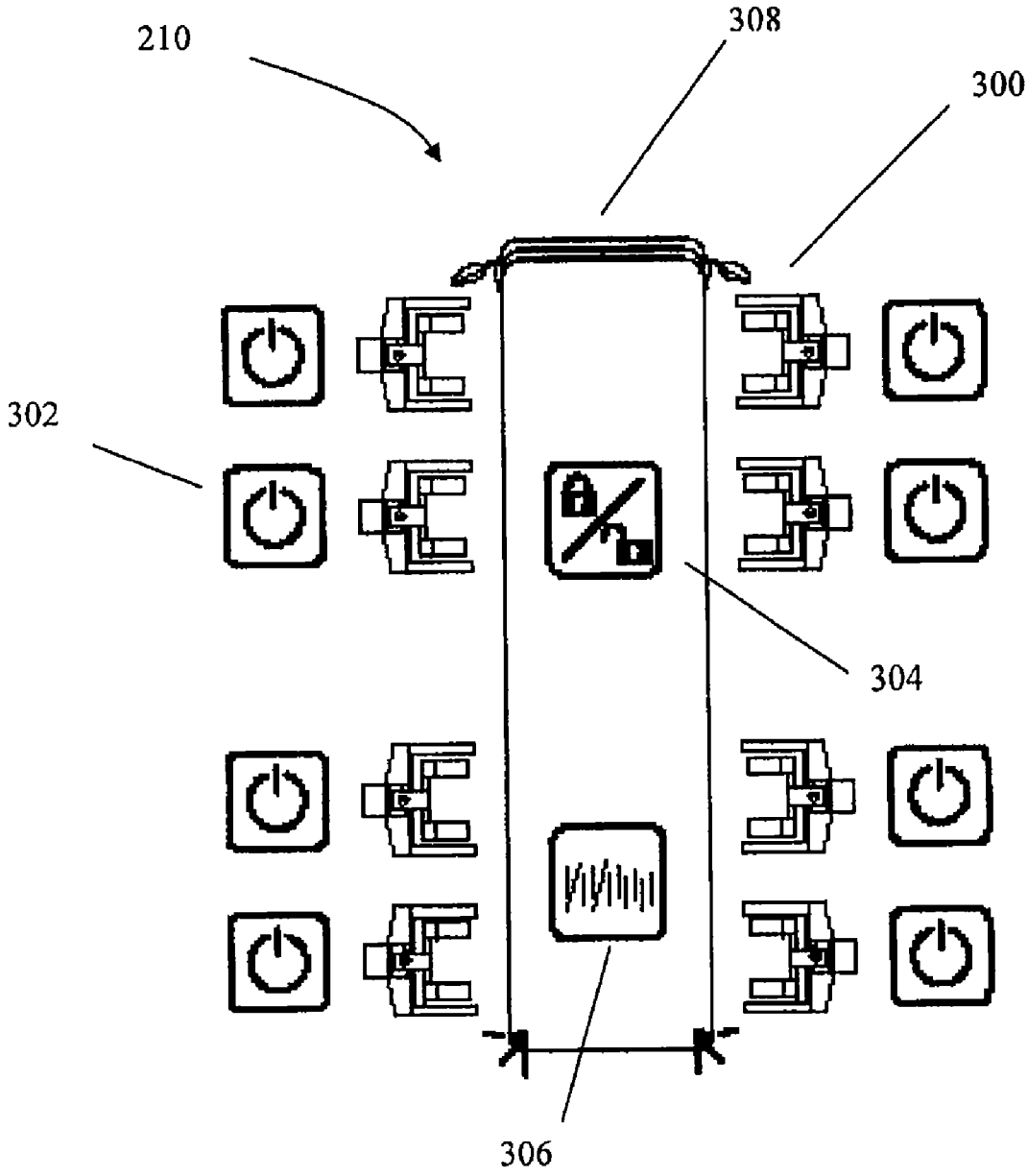
FIG. 6 illustrates the column configuration panel of the interface in FIG. 5.

The exemplary column configuration (210) depicted in FIGS. 5-6, showing eight columns (2) in a control group around an indication (308) of a bus, may permit a user to understand the relationship between columns (2) and a vehicle (e.g., a bus, etc.) on interface (200) relatively quickly and with relative ease. In other words, having a graphical representation (300) of columns (2) and a corresponding graphical representation (308) of a vehicle may permit a user to immediately recognize the actual position of each column (2) relative to the vehicle, and select/command columns (2) based on the column (2) positions so indicated. Column configuration (210) on interface (200) may thus show, using a graphical representation (300) of columns (2) and a graphical representation (308) of a vehicle, two types of relationships—the relationships between columns (2) (e.g., positioning of columns (2) relative to one another, relative to other columns (2) in a column group, etc.), as well as the relationships between columns (2) and a vehicle (e.g., positioning of columns (2) relative to certain portions of a vehicle, etc.). Such an aspect of interface (200) need not be limited to the example depicted in FIG. 5. Numerous other examples of interfaces exist that may allow a user to understand the relationship between columns (2) and the vehicle being supported by columns (2) relatively quickly and with relative ease. By way of example only, representations (300, 308) need not necessarily be graphical. For instance, either or both types of representations (300, 308) may comprise lights (e.g., LEDs), textual representations, numerical representations, alphanumerical representations, symbolic representations, or any other suitable types of representations.

Recognizing the relationship between columns (2) and a vehicle in such a way as provided by interface (200) may permit a user to more easily select columns (2) by not requiring the user to visually inspect where the physical components of lift system (1) are in relation to a vehicle. This aspect of interface (200) may be particularly useful when selecting column (2) groups for operation. When selecting a column (2) group, for example the front two columns (2) in FIG. 5, the user may find it relatively simpler to use interface (200) that independently permits a user to understand the relationship between the columns (2) and the vehicle. In other words, the user may simply approach one interface (200) at any one of columns (2) and activate a button (302) or other feature associated with the graphical representations of the front two columns (2) in order to select those two columns (2) to define a column (2) group (e.g., rather than having to refer to a tag on the two columns (2) to determine certain numbers or other identifiers associated with the front two columns (2), then having to enter such numbers or other identifiers into a system in order to effect selection of such columns (2) to define a group; or rather than having to approach each of the front two columns (2) individually to activate certain features physically located on each of the front two columns (2) in order to effect selection of such columns (2) to define a group; etc.).

Furthermore, understanding the relationship between columns (2) and/or the relationship between columns (2) and a vehicle, simply by viewing graphical representations (300, 308) of columns (2) and vehicle on interface (200), may also make it easier to comprehend different features associated with each column (2) or column (2) group. For instance, by viewing graphical representations (300, 308) of columns (2) and vehicle on interface (200), a user may be able to immediately recognize which columns (2) are in the system, which columns (2) are activated/deactivated, which columns (2) are selected/deselected as part of a column (2) group, which columns (2) are positioned at certain locations relative to a vehicle, etc.

During initial setup of lift system (1), and any time a column (2) is added to an already setup lift system (1), an operator may register columns (2) with lift system (1). This registration process may establish the relationship between columns (2) and a vehicle (e.g., where each column (2) is in relation to a part of a vehicle). In other words, the registration process may assign column (2) positions. As one mere example of a column (2) registration process, a user may begin by coupling one or more cables (150) of a new column (2) with one or more cables (150) or ports (109) of at least one other column (2) in lift system (1), and powering on the new column (2). At that stage, the new column (2) may be initially coupled with lift system (1).

In wireless versions, a transceiver in the new column (2) may automatically wirelessly couple with one or more other columns (2) in lift system (1) when the new column (2) is powered on. To the extent that a facility has several lift systems (1) with wireless communication, the lift systems (1) may each have their own unique ID which may be perceived through wireless communications, and such lift systems (1) may each wirelessly communicate whether they are in a mode to accept new lift columns (2). For instance, the lift system (1) in which the new column (2) is to be added may wirelessly communicate its receptiveness to the addition of one or more new columns (2); while lift systems (1) having locked column (2) configurations may wirelessly communicate their non-receptiveness to the addition of one or more new columns (2). Alternatively, lift systems (1) having locked column (2) configurations may be simply non-responsive to a query that is wirelessly transmitted from the new column (2) when the new column (2) is powered on; while the lift system (1) in which the new column (2) is to be added may wirelessly respond to a query wirelessly transmitted from the new column (2) when the new column (2) is powered on. Alternatively, a new column (2) may establish an initial wireless coupling with one or more columns (2) in the appropriate lift system (1) in any other suitable fashion, as will be apparent to those of ordinary skill in the art in view of the teachings herein.

Upon initial coupling with one or more other columns (2) of lift system (1), the interface (200) on the new column (2) may indicate the presence of other columns (2) already registered with lift system (1). For instance, on the interface (200) of the new column (2), graphical representations (300) of such already registered columns (2) may flash, may illuminate in green or some other color, or may provide some other indication. Alternatively, buttons (302) or LEDs, etc., that are associated with such registered columns (2) may flash, may illuminate in green or some other color, or may provide some other indication. The user may then press whichever button (302) is associated with the position of the new column (2) in relation to a vehicle. For instance, if the new column (2) is being positioned at the front passenger side position, the user may press the button (302) that is positioned closest to the front passenger side wheel of graphical representation (308) of the vehicle. Once the user presses this button (302), the graphical representation (300) of the column (2) in that position on interface (200) (or the button (302) in that position, or an LED associated with that position, etc.) may flash, illuminate in yellow or some other color, or provide some other indication to show that the position has been assigned for the new column (2). On the interfaces (200) of the previously registered columns (2), the graphical representation (300) of the column (2) at the front passenger side position of the graphical representation (308) of the vehicle (or the button (302) in that position, or an LED associated with that position, etc.) may flash, illuminate in green or some other color, or provide some other indication to show that the position has been assigned for the new column (2). Of course, any other suitable components and processes may be used to register columns (2) in a lift system (1); and to indicate the registration of columns (2) in a lift system (2).

After registering the new column (2) to lift system (1) (and any other new lift columns (2)), the user may activate the configuration lock member (304) as described in greater detail below. Activation of configuration lock member (304) may lock the registrations of columns (2), which may thereby prevent additional columns (2) from being added or registered to lift system (1). Lift system (1) may be configured such that columns (2) of lift system (1) are fully or partially inoperable (e.g., carriers (6) will not move) until the registrations of columns (2) are locked by activation of configuration lock member (304). In some versions, configuration lock member (304) may be inoperable to lock registrations of columns (2) when there is an inappropriate number of columns (2) or inappropriate relationship between registered columns (2), etc. After columns (2) have been appropriately registered, and configuration lock member (304) has been activated to lock the registration, lift system (1) may further require a subsequent activation of configuration lock member (304) to unlock lift system (1) for later registration of additional new columns (2). Alternatively, as noted below, configuration lock member (304) may be varied or omitted if desired.

The above described column (2) registration process (or any variation thereof) may be carried out each time a column (2) is added to or removed from lift system (1). For instance, a column (2) that is being removed from lift system (1) may be unregistered from lift system (1); while a column (2) that is being added to lift system (1) may be registered with lift system (1). In some versions, where a second column (2) is being used to replace a first column (2), the user may simply register the second column (2), which may essentially overwrite or otherwise render moot the prior registration of the first column (2), such that the user need not actively unregister the first column (2). In some other versions, where a second column (2) is being used to replace a first column (2), lift system (1) may automatically recognize the decoupling of the first column (2) and the coupling of the second column (2), and may thereby automatically register the second column (2) in place of the first column (2). Still other ways in which columns (2) may be registered and/or unregistered with lift system (1) will be apparent to those of ordinary skill in the art in view of the teachings herein.

After the desired columns (2) have been registered with lift system (1), each column configuration panel (210) may permit a user to select or deselect columns (2) graphically represented on interface (200) to define a column control group. Such selection or de-selection may be accomplished by activating the buttons (302) shown adjacent to the icons (300) representing columns (2). The selection/de-selection of columns (2) may be visually indicated in a variety of ways, including but not limited to illuminating the icon (300) representing a selected column (2) and/or illuminating the button (302) adjacent to a selected column (2). In this example, icons (300) representing non-selected columns (2) and/or buttons (302) adjacent to non-selected columns (2) may be left unilluminated. Further features of column configuration panel (210) of the present example will be described in greater detail below with reference to FIG. 6. Nevertheless, still other ways of indicating which columns (2) are selected and which columns (2) are not selected (e.g., using visual, audio, and/or other techniques) will be apparent to those of ordinary skill in the art in view of the teachings herein.

Upon completing the selection or de-selection of the appropriate columns (2), control interface (200) may permit the user to direct movement of the selected columns (2). In other words, the user may simultaneously control all of the selected columns (2) in the column control group using any of the control interfaces (200). In this example, whichever column (2) is supporting the control interface (200) that is being used to control lift system (1) may be regarded as the master column (2). Those columns (2) supporting control interfaces (200) that are controlled by the master column (2) may be described as slave columns (2). Alternatively, as noted above, lift system (1) may lack a master/slave architecture.

The example of control interface (200) depicted in FIG. 5 further comprises at least one control element for operating lift system (1). In the example depicted in FIG. 5, a plurality of control members comprise an emergency stop member (212), a movement control member (214), a slow descent member (216), and a lower to locks member (218). The emergency stop member (212) may permit the user to stop movement of a specific column (2), stop movement a group of columns (2) (e.g., stop all columns (2) in a group simultaneously), and/or stop all movement in lift system (1). Emergency stop member (212) may comprise a thin film switch with membrane overlay or any other suitable construction or configuration.

The movement control member (214) of the present example may permit the user to direct movement of lift system (1) with respect to a single column (2), selected columns (2), and/or a column (2) group. In the present example, movement control member (214) comprises a button representing an "up" arrow and a button representing a "down" arrow. Movement control member (214) may be configured such that actuation of the button representing an "up" arrow causes the carriers (6) on one or more columns (2) to move upward; and such that actuation of the button representing a "down" arrow causes carriers (6) on one or more columns (2) to move downward. Movement control member (214) may thus be used to control vertical movement of a carrier (6) of a specific column (2), to control vertical movement of carriers (6) of a group of columns (2) (e.g., raise or lower the carriers (6) of all columns (2) in a group simultaneously), etc. "Up" and "down" arrow buttons of movement control member (214) may comprise thin film switches with membrane overlay or any other suitable construction or configuration.

Slow descent member (216) of the present example is associated with a turtle icon, and permits a user to control the descent of carrier (6) along column (2) and/or carriers (6) of a selected column (2) group in a relatively slower manner than as otherwise permitted by the movement control member (214). A user may toggle slow descent mode on or off by pushing slow descent member (216). For instance, slow descent member (216) may comprise a thin film switch with membrane overlay or any other suitable construction or configuration. Slow descent member (216) may be provided with visual or other indication to indicate to the user whether lift system (1) (or just one or more columns (2)) is in a slow descent mode. For instance, the turtle icon associated with slow descent member (216) may be illuminated when lift system (1) is in a slow descent mode; and unilluminated when lift system (1) is not in a slow descent mode. Other indications may be used as desired. Alternatively, as with any other component described herein, slow descent member (216) may be modified, substituted, supplemented, or omitted as desired.

Lower to locks member (218) of the present example may permit the user to lower the carrier (6) of a selected column (2), or carriers (6) of selected columns (2), such that carrier(s) (6) descend to engage a mechanical lock feature, which may prevent further downward movement of carrier(s) (6) until the mechanical lock feature is disengaged. For instance, each column (2) may have a mechanical lock feature that comprises a lock bar (not shown) and an engaging component (not shown) that is configured to engage the lock bar. Such mechanical lock features may permit carriers (6) to ascend freely; while selectively restricting descent of carriers (6). In particular, the mechanical lock features may prevent carriers (6) from descending unless a lock release is activated (e.g., an activated lock release may prevent the engaging component from engaging the lock bar). During normal descent of carriers (6), the lock releases may be activated to permit carriers (6) to descend without being impeded by the lock features. When carriers (6) are not in a normal descent mode (e.g., during an ascent mode), the lock releases may be de-activated, such that the lock features may prevent a carrier (6) from falling to the ground in the event of a sudden pressure loss in the cylinder (102) associated with carrier (6). Lock bars may be vertically positioned at every 3 inches (without necessarily going all the way to the floor), or at any other suitable positioning.

Thus, when an operator activates lower to locks member (218), such activation may open a descent valve, bleeding hydraulic fluid from cylinder (102) to allow carrier(s) (6) to descend, while not activating the lock releases. During such descent of carrier(s) (218), the associated engaging component(s) eventually engages the associated lock bar(s), such that the lock feature bears the load of carrier (6) and the vehicle instead of the hydraulic system bearing the load of carrier (6) and the vehicle. Of course, other configurations of lock features may be used, or lock features may even be omitted if desired. Lower to locks member (218) may comprise a thin film switch with membrane overlay or any other suitable construction or configuration.

In further versions of control interface (200), other means and methods for controlling lift system (1) by control elements on a control interface will become apparent to those in the art in view of the teachings herein. For example, in one version, a slow ascent member may permit a user to control the ascent of column (2) and/or column (2) group in a slower manner than as otherwise permitted by movement control member (214). In another version, movement control member (214) may be used to initiate the ascent and descent of lift system (1) while a speed control member (not shown) may vary the speed with which the carriers (6) ascent and descent in response to actuation of movement control member (214).

FIG. 6 shows column configuration panel (210) of the present example in greater detail. In this example, column configuration panel (210) comprises a plurality of graphical representations (300) of columns (2), a plurality of column selection members (302), a configuration lock member (304), and a mode switch member (306). Configuration panel (210), as depicted in this example, resembles lift system (1) with an outline (308) of a vehicle (e.g., a bus). Graphical representations (300) of columns correspond to the columns (2) associated with lift system (1). In the example of FIG. 6, lift system (1) may comprise eight columns (2) based on the outline (308) of the vehicle comprising eight wheels. Therefore, eight graphical representations (300) of columns (2) are shown. Of course, other numbers of columns (2) and other configurations may be used.

A selection member (302) is positioned adjacent to each graphical representation (300) of a column (2). Selection member (302) may allow the user to select or deselect a represented column (2) by pressing column selection member (302). For instance, each selection member (302) may comprise a thin film switch with membrane overlay or any other suitable construction or configuration. The selection or non-selection of columns (2) may provide a variety of results. For instance, in some versions, non-selected columns (2) are disabled entirely, while selected columns (2) are operable. In other versions, non-selected columns (2) are operable, yet are only operable by their own control interfaces (200) as opposed to being operable through control interface (200) on another column (2); while the selected columns (2) are operable through whichever control interface (200) is being used by the user. Configuration panel (210) may thus be used to selectively control a desired number of columns (2); selectively control the operability of a desired number of columns (2); and/or selectively adjust the operability of interfaces (200) associated with a desired number of columns (2). Other suitable implications of selections/non-selections made through configuration panel (210) will be apparent to those of ordinary skill in the art in view of the teachings herein. It will also be appreciated that a user may use selection members (302) to define a column (2) group (e.g., selecting columns (2) that are to be in the group, de-selecting columns (2) that are to be excluded from the group, etc.), by manipulating a single control interface (200) on any column (2).

Furthermore, selection members (302) need not necessarily be positioned adjacent to each graphical representation (300) of columns (2), as selection members (302) may be positioned at any other suitable locations. In some versions, selection members (302) and graphical representations (300) of columns (2) are combined. For instance, a graphical representation (300) of a column (2) may be printed on a membrane, under which may be a corresponding thin film switch or other feature, such that a user may select column (2) simply by pushing on the corresponding graphical representation (300) of the column (2) on control interface (200). As a similar variation, selection members (302) may be provided as buttons, and a graphical representation (300) of column (2) may be printed on each of the buttons. Still other suitable relationships between selection members (302) and graphical representations (300) of columns (2) will be apparent to those of ordinary skill in the art in view of the teachings herein.

A variety of indicators may be used to otherwise notify or indicate to the user whether a graphically represented column (2) has been selected or deselected. For example, upon a user selecting graphically represented column (2), graphical representation (300) of the selected column (2) may be illuminated. In another version, selection member (302) associated with the selected column (2) may itself may be illuminated. In other versions, other types of notification, indicators, structures, components, techniques, or markings may be used to illustrate the selection or non-selection of graphically represented columns (2).

For example, in the example of panel (210) depicted in FIG. 6, LED indicators may be used to help identify a status of column (2), a selected group of columns (2), and/or all of the columns (2). Selection members (302) may comprise LED indicators that change colors to represent different configuration settings, selection settings, and/or other variable settings (e.g., green LED indicates selection of associated column (2), red LED indicates non-selection or de-selection of associated column (2), etc.). Further, the LED indicators may flash according to at least one rate. Each flashing rate may represent or indicate a different message or indication to be delivered to the user.

In the example depicted in FIG. 6, panel (210) may further comprise a configuration lock member (304) that may permit the user to lock or unlock the current column (2) configuration. Configuration lock member (304) may comprise a thin film switch with membrane overlay or any other suitable construction or configuration. As noted above, configuration lock member (304) may lock the configuration of represented column(s) (2) such that no columns (2) may be added to or removed from a lift system (1) until configuration lock member (304) is actuated again to unlock lift system (1). In some versions, configuration lock member (304) may operate manually, automatically, via a wireless control module, or otherwise, including combinations thereof. It will therefore be appreciated that functions of lock member (304) of the present example may be provided without necessarily providing configuration lock member (304) on panel (210), or without necessarily providing a button dedicated to such functionality. In other words, configuration lock member (304) and even some or all of its associated functionality may be completely omitted, if desired.

In another example of lift control interface (200), interface (200) may comprise a lift system locking member (not shown) that locks at least one lift control interface (200). A system locking member on each lift control interface (200) for each column (2) may provide the user with the ability to lock any and all control interfaces (200) of the lift system (1). In a further example, the user may choose to leave at least one lift control interface (200) unlocked for later access. For example, the vehicle corresponding to graphical representation (308) in FIG. 6 comprises eight wheels. The user may operate a lift system (1) locking member to lock seven lift control interfaces (200) and thus only permit use of a single control interface (200) of a lift column (2) at one of the eight wheels. Of course, while seven lift control interfaces (200) would be locked in this particular example, the one non-locked control interface (200) may still be used to control all eight lift columns (2) individually or simultaneously.

In another example, as depicted in FIG. 6, panel (210) comprises a mode switch member (306). Mode switch member (306) may comprise a thin film switch with membrane overlay or any other suitable construction or configuration. In one example, mode switch member (306) may permit the user to switch to a "single column" mode, "pair column" mode, "all column" mode, "no column" mode, and/or any other suitable pre-set modes. For example, the user may select the "all column" mode in order to avoid taking the time to select each column (2) individually. In another example, the user may deselect all the columns (2) by choosing a "no column" mode. Yet further, in an example comprising a "point-of-use" mode, operation of lift system (1) may be allowed only from column (2) where the controls are being accessed. As with all modes, the operation of columns (2) may be permitted from any column (2), regardless of whether column (2) is in a locked or unlocked position for purposes of raising or lowering an object. However, in another example, the user may set a mode to only permit operation of lift system (1) from an unlocked column capable of raising or lowering an object.

Yet further, in another version, a mode switch member (306) may permit the user to create and label stored modes. For example, in the example depicted in FIG. 6, where the vehicle corresponding to graphical representation (308) comprises eight wheels, the user may program and label a stored mode where only the left columns (2) are selected. Permitting the creation and labeling of stored modes may save time and energy, such as in situations where routine maintenance is performed that requires multiple lift system (1) settings. Of course, mode selection and/or creation may be omitted entirely if desired. In other words, as with any other feature and component described herein, mode switch member (306) is merely optional.

An additional example of lift control interface (200) may comprise an alarm element (not shown). In this example, if lift system (1) is configured or about to be configured in a manner deemed dangerous or undesired (e.g., carriers (6) set at heights deemed dangerously disparate, carriers (6) raised too high, etc.), the alarm element may notify the user as to the undesired condition and/or lock the movement of carriers (6). A further example may comprise an alarm element notifying the user of an attempt to simultaneously control lift system (1) by more than one lift control interface (200). In addition to or in lieu of preventing movement of carriers (6), the alarm element may provide an audio and/or visual indication of alarm conditions. In other versions, an alarm element may automatically lower all carriers (6) to the ground under some conditions. Furthermore, an alarm element may be configured to provide different responses based on different conditions or combinations of conditions. For instance, an audio and/or visual alarm element may provide an alert indicating that carriers (6) are lowering to the ground during normal use of lift system (1), indicating to bystanders that they should be sufficiently clear from lift system (1) to avoid injury. Alternatively, an alarm element may be omitted, just like any other component described herein.

Yet further, an example of column configuration panel (210) may comprise a variety of colors associated with different indicators or other identification structures, or components. For example, yellow may indicate the position of column (2) being viewed or used. Green may indicate other columns (2) currently communicating with the lift system (1). Red may indicate a column (2) having an error or other problem, including but not limited to misalignment. In one version of control interface (200), these colors can be specifically incorporated into graphical representations (300) of columns (2) or may be positioned adjacent to the graphical representations (300). Additionally, an endless variety of colors and locations of colors may be so selected and created as so desired with regard to any and all indicators including, but not limited to, configuration lock member (304), mode switch member (306), a configuration switch member, movement control member (214), and so on.

To the extent that one or more light sources are incorporated into control interface (200), such light source(s) may also provide a variety of flash rates to convey information. For example, control interface (200) may incorporate a slow flash rate to indicate a deselected column (2) in a locked position. A medium flash rate may indicate a configured position of the column (2) being viewed or used. Further, a fast flash rate may be used to indicate a column (2) with an error. Of course, an endless variety of flash rates can be used as so desired. These flash rates may be incorporated in a version of control interface (200) by positioning the flash rates into the graphical representations (300) of columns (2) or in an object adjacent to the graphical representations (300) of columns (2) (e.g., a separate LED). Similar to the colors of LED indicators, an endless variety of flash rates may be so selected and created as so desired with regard to any and all indicators including, but not limited to, configuration lock member (304), mode switch member (306), configuration switch member, movement control member (214), and so on. One may coordinate the flash rates and the colors of LED color indicators.

In some versions, sound is incorporated into control interface (200) (or otherwise incorporated into lift system (1)) to convey information. Control interface (200) may thus include a buzzer, speaker, or other suitable component(s) for delivering sound. Any suitable sound(s) may be used, including but not limited to buzzing, chirping, beeping, a long tone, etc. These sounds may be selected or pre-programmed. For example, a beeping sound may be used to convey that carrier (6) is being raised or lowered. Further, an alarm sound may be used to convey that column (2) has reached its maximum height. One may program the master column (2) to emit a sound after a pre-programmed time length to remind or notify users which column (2) is the master column (2). Different properties of sounds may thus indicate different information relating to lift system (1), including but not limited to information relating to use or operation of lift system (1) and/or the condition of lift system (1). Such sounds may vary based on timbre, pitch, pattern, rhythm, melody, etc. Other suitable ways in which sound may be incorporated into lift system (1) will be apparent to those of ordinary skill in the art in view of the teachings herein. Alternatively, such sound features may be omitted altogether.

In further examples of lift system (1) and/or control interface (200), lift system (1) may embody an identification system or other process for ensuring that any activity relating to lift system (1) (e.g., adding a column (2), removing column (2), operating lift system (1)) occurs safely and as desired. For example, the identification system can recognize a user, require a password from the user via biometrics, or perform other actions such as recognizing a remote operating source via an electronic handshake where wireless communication is used. Additionally, a version of the identification system may only recognize users, columns (2), and other objects based on identification numbers or strings. Therefore, if a user attempts to add a column (2) having an identification number or string that is already active in the lift system (1), the identification system may provide an error message to the user. Another example of a lift system (1) would permit the identification system to recognize the position of various columns (2) having identification numbers whereby the system (1) could verify configuration of the system (1) prior to operation. This identification system can be incorporated into lift control interface (200) by a variety of structures, components, and techniques, such as by inputting data to display (202).

Finally, a merely exemplary use of lift control interface (200) will be described. First, the operator may "enter" columns (2) into lift system (1) or "add" columns (2) to lift system (1). For example, in a wireless lift system (1), the operator may assign column (2) to lift system (1) after column (2) powers up. In some versions, if lift system (1) is already stored on control interface (200) of column (2), then column (2) may not need to be added to lift system (1). Any suitable technique, structure, or method may be used to add column (2) to lift system (1) and vice versa. For example, lift system (1) may include an associated system identification number. When column (2) is powered on, the system identification number for lift system (1) may be entered into interface (200). More specifically, the system identification number may be entered using display (202). This may include searching for any available system identification number, and selecting the applicable number.

As part of the process of adding columns (2) to lift system (1), or after columns (2) are added to lift system (1), the operator may indicate the position of each column (2) being entered into lift system (1), using the user interface (200) on each or any column (2) being entered into lift system (1). For instance, the operator may enter into user interface (200) that a column being added to lift system (1) is positioned at a location where the front driver's side wheel of a vehicle that is to be raised and lowered by lift system (1) will be positioned. This may otherwise be known as the lift system (1) configuration process. In some versions, only a single control interface (200) on column (2) is used to accomplish this task and/or to operate lift system (1). The first column (2) assigned to a lift system (1) may be labeled as the master column (2). The remaining columns in lift system (1) may be labeled as slave columns (2). Alternatively, master/slave relationships may be established in any other fashion, such as those techniques described herein; or master/slave designations may be omitted altogether.

When a column (2) is added to lift system (1), the graphical representations (300) associated with already-added columns (2) in lift system (1) may illuminate green on control interface (200) of added column (2), such as through an LED indicator, to indicate that these columns (2) are already entered into lift system (1). The user may press the associated column button (302) on control interface (200) to select a column (2) to add or remove from the lift system (1). An LED associated with that button (302) may flash yellow at a medium rate to indicate that a position is assigned for that column (2). When removing columns (2) from lift system (1), the LED indicators for associated buttons (302) may flash red at a medium rate. The above process may be repeated until all desired columns (2) have been entered into lift system (1). Once the desired columns (2) have been added to lift system (1), the user may lock the configuration into place by pressing configuration lock member (304).

When the configuration is locked, the configuration lock member (304) LED may glow steadily green. Any medium flashing yellow LED indicators relating to selected columns (2) may turn solid green as these columns (2) are part of the lift system (1). Any medium flashing red LED may become solid red as these columns (2) are not part of the lift system (1). Further, once the lift system (1) has been configured and locked, the 3-digit, 7-segment display (202) may default to display the column (2) height on the associated column (2) of which control interface (200) is attached. Display (202) may remain through operation of lift system (1) unless the user desires otherwise or an error occurs. Additionally, some monitor or communication messages may appear on display (202), but display (202) may return to its original state after a specified amount of time. After this final configuration, additional columns (2) may still be added or removed to lift system (1) by unlocking the existing configuration and then configuring the additional columns (2) as described above.

After all desired columns (2) have been entered into lift system (1) and the configuration is locked, the operator may then assign selected columns (2) to a control group. In particular, the user may select or de-select columns (2) based on a single column (e.g., any selected column (2) in lift system (1)), a point-of-use (e.g., only operating the column (2) at which the control interface (200) that is being used is located), a column pair, a pair group, or pair(s) plus one, column (2) pairs at both ends of the vehicle, all columns (2), or any other layout of columns (2) in the lift system (1). In other words, by assigning columns (2) to a control group, the operator may simultaneously operate all columns (2) that are in the control group via any interface (200) at any column (2) in the group. As stated earlier, the user may not necessarily want to use every column (2) in the lift system (1) for a variety of reasons, such that certain control group assignments may exclude certain columns (2) that have nevertheless been entered into lift system (1). Columns (2) that are part of lift system (1) but excluded from a control group may remain substantially motionless as the columns (2) that are assigned to a control group raise and lower their carriers (6) in accordance with the operator's instructions.

Upon selecting and assigning desired columns (2) to a control group, the user may operate lift system (1). Operating lift system (1) through lift control interface (200) may comprise a variety of steps depending upon the user's desired actions. For example, the user may cause lift system (1) to elevate the vehicle on columns (2) by using movement control button (214). The speed with which a vehicle is raised or lowered may vary based on a speed control component that permits the user to adjust the speed with which carriers (6) raise or lower the vehicle. Further, the user may monitor the movement of columns (2) in real time or by observing height limit component (206). Upon reaching a desired setting, the user may select a configuration lock member (304) to lock the columns (2) in place such that the columns (2) cannot be altered. Performing this type system locking may comprise having the user lock down all or some of lift control interfaces (200).

During operation, if the user so desires to view the height level of carrier (6) of each column (2), the user may select a represented column (2), even while lift system (1) is in a locked mode, to view related information in a display on lift control interface (200). If the user would so desire to control a column (2) or group of columns (2) to lower a vehicle, the user may use a different control interface (200) to lower the vehicle as opposed to control interface (200) used to raise the vehicle. Upon selecting and locking the column(s) (2) to lower, the user may lower the column(s) (2) by using movement control member (214). In this version, a varying speed control feature may exist on control interface (200) to permit the user to vary the speed with which the vehicle lowers towards the ground.

Accordingly, in the previously described operation of this example of lift system (1), the activities by a user may occur from a single control interface (200). Yet further, in this example of lift system (1), the user may utilize any of control interfaces (200) within this configuration as a master control interface that controls lift system (1) and any associated columns (2). This feature of this example of lift system (1) may save a great deal of time and energy operating lift system (1), may ensure easier accessibility to information relating to lift system (1), and may create a safe working environment. Alternatively, such results may not be obtained in some settings.

Display (202) of control interface (200) may comprise an alpha-numeric display or other graphically dynamic display. For instance, an alpha-numeric display may comprise an LCD display and/or set of LED's providing a display. In some versions, an alpha-numeric display is formed by characters that are selectively illuminated by LED's, with the characters being formed of segments arranged in a block-like "figure 8" and/or a "figure 8" with an "X" superimposed over its center. Such segments may be selectively illuminated by LED's to provide representations of various numbers and letters, and may "scroll" horizontally to display lines of numbers and/or text that exceed the width of display (202). Such displays (202) may render a variety of types of information under any suitable conditions, as will be apparent to those of ordinary skill in the art in view of the teachings herein. By way of example only, such a display (202) may display a carrier (6) height, one or more error codes or fault codes, an indication of which particular column(s) (2) in a group need maintenance or attention, or any other information.

Any of the above-noted user input features of control interface (200) may take a variety of forms. For instance, user input features may include thin film switches and/or membrane switches, electromechanical buttons, dials, levers, sliders, or any other suitable devices, structures, or components, including combinations of different types.

Control interface (200) may also be configured to communicate with one or more remote computers or devices (e.g., desktop computer, laptop computer, phone, BLACKBERRY, etc.), via wire (e.g., via RJ45 cables) and/or wirelessly (e.g., using any suitable wireless communication modality or protocol). For instance, a control interface (200) may transmit data, commands, etc. to a remote device. A control interface (200) may also receive data, commands, etc. from a remote device. A remote device may thus be used to perform diagnostics on a given column (2) or lift system (1). Some examples of how such communication may be implemented are disclosed in U.S. Pat. No. 7,191,038, entitled "Electronically Controlled Vehicle Lift and Vehicle Service System," issued Mar. 13, 2007, the disclosure of which is incorporated by reference herein in its entirety, while other examples will be apparent to those of ordinary skill in the art in view of the teachings herein.

It will also be appreciated that lift system (1) may be configured such that a user's configuration of lift system (1) (e.g., selections of columns (2), column (2) positions, height limit, other parameters or selections entered through control interface (200), etc.) may be saved during power-off of lift system (1). Such information may be stored on any suitable storage device or storage devices (e.g., hard drives, flash memory cards, etc.) residing locally at one or more columns (2) and/or located remotely. Accordingly, the next time lift system (1) is turned on, it may load or recall the previous configuration, and may implement the same. Such saving of a user's configuration may be performed automatically upon power-off of lift system (1). In addition or in the alternative, control interface (200) may present a feature configured to permit a user to save the configuration (e.g., a "save" button, etc.) for future recall. To the extent that lift system (1) has a feature configured to distinguish one user from another, configuration data may be saved for each user and be associated with the user's unique identification, such that saved lift system (1) configurations may be loaded upon power on of lift system (1) on a per user basis. Lift system (1) configuration data may also be stored and recalled on a per vehicle basis (e.g., different types of vehicles associated with different configurations of lift system (1)). Still other ways in which configurations of lift system (1) may be saved, recalled, and implemented will be apparent to those of ordinary skill in the art in view of the teachings herein.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A lift control interface for governing a lift system including a plurality of lift columns, the lift control interface comprising:

(a) a display operable to display information relating to the lift system, wherein the display comprises:

(i) a plurality of visual representations that correspond to lift columns in the lift system, and (ii) at least one visual representation corresponding to a vehicle, wherein the display is configured to show relationships between the lift columns in the lift system and the vehicle through the visual representations; and (b) a column configuration panel including a plurality of user input features, wherein at least one of the user input features is operable to assign at least one selected lift column of the plurality of lift columns to a column control group, wherein the column configuration panel is operable to simultaneously control the selected lift columns assigned to the column control group, wherein the display is further configured to visually indicate selected lift columns assigned to the column control group in relation to the vehicle.

2. The lift control interface of claim 1, wherein the column configuration panel is operable to introduce additional lift columns into the lift system.

3. The lift control interface of claim 2, wherein the column configuration panel further comprises a lock member operable to selectively permit or prevent introduction of additional lift columns into the lift system.

4. The lift control interface of claim 1, wherein the display further comprises:

(i) a screen operable to display information relating to the lift system, and (ii) a control section for altering the information shown on the screen.

5. The lift control interface of claim 1, wherein the plurality of user input features comprise a plurality of column activation members that each respectively correspond to a represented lift column, wherein the column activation members are operable to activate selected lift columns to define a lift column control group.

6. The lift control interface of claim 5, further comprising at least one control member operable to control the activated lift columns in the lift system.

7. The lift control interface of claim 6, further comprising a mode switch operable to select a mode from a plurality of modes, wherein each of the modes groups predefined sets of columns for control by the control member.

8. The lift control interface of claim 1, wherein the display further comprises a respective status indicator representing at least one status state selected from the group consisting of: selected, error, viewing, using, master, and slave.

9. The lift control interface of claim 1, wherein the plurality of visual representations that correspond to lift columns in the lift system comprise icons graphically representing lift columns.

10. The lift control interface of claim 1, wherein the at least one visual representation corresponding to a vehicle comprises an icon graphically representing a vehicle.

11. The lift control interface of claim 10, wherein the plurality of visual representations that correspond to lift columns in the lift system comprise icons graphically representing lift columns, wherein the icons graphically representing lift columns are arranged about the icon graphically representing a vehicle to indicate relationships between lift columns of the lift system and the vehicle.

12. A lift system comprising:

(a) a plurality of lift columns; and (b) a plurality of lift control interfaces, wherein each lift control interface corresponds to an associated lift column of the plurality of lift columns, wherein each lift control interface is operable to select specific lift columns from the plurality of lift columns for operation, wherein each lift control interface from the plurality of lift control interfaces is operable to govern operation of the selected lift columns, wherein the plurality of lift control interfaces are in communication with each other.

13. The lift system of claim 12, wherein each of the lift control interfaces comprises a display portion, wherein the display portion is configured to visually indicate which lift columns of the plurality of lift columns are selected for operation.

14. The lift system of claim 13, wherein the display portion comprises a plurality of graphical representations of the lift columns, wherein the lift control interfaces each further comprise a plurality of lift column selectors, wherein each lift column selector is associated with a corresponding lift column, wherein each lift column selector is positioned adjacent to one or both of the graphical representation representing the lift column associated with the lift column selector or a status light associated with the graphical representation representing the lift column associated with the lift column selector.

15. The lift system of claim 12, wherein each configuration member of the plurality of lift control interfaces is operable to lock the selection of lift columns, wherein the configuration members of the plurality of lift control interfaces are configured to display the locking of the selection of lift columns.

16. The lift system of claim 12, wherein each lift control interface further comprises a lift column mode selector, wherein the lift column mode selector is operable to automatically select predefined sets of lift columns in accordance with a lift column mode selected through the lift column mode selector.

17. The lift system of claim 12, wherein each lift column comprises a carriage configured to engage and raise a vehicle, wherein each lift control interface further comprises a carriage height limit mode selector, wherein the carriage height limit mode selector is operable to selectively limit the vertical height at which the carriages may be raised.

18. The lift system of claim 12, wherein each lift control interface comprises a plurality of thin film switches operable to select specific lift columns from the plurality of lift columns for operation.

19. A lift system comprising:

(a) a plurality of lift columns; and (b) a plurality of lift control interfaces, wherein each lift control interface corresponds to an associated lift column of the plurality of lift columns, wherein each lift control interface comprises (i) at least one user input feature operable to select specific lift columns from the plurality of lift columns for operation, and (ii) at least one status indicator, wherein the at least one status indicator is configured to indicate a status associated with each of the lift columns on a per column basis.

20. The lift system of claim 19, wherein the at least one status indicator comprises a plurality of status indicators, wherein each status indicator of the plurality of status indicators is associated with a corresponding lift column of the plurality of lift columns.

* * * * *